US007362286B2

(12) United States Patent
Fang

(10) Patent No.: US 7,362,286 B2
(45) Date of Patent: Apr. 22, 2008

(54) DUAL BAND ANTENNA DEVICE, WIRELESS COMMUNICATION DEVICE AND RADIO FREQUENCY CHIP USING THE SAME

(75) Inventor: Shyh-Tirng Fang, Tainan (TW)

(73) Assignee: Mediatek Inc., Hsin-Chu (TW)

( * ) Notice: Subject to any disclaimer, the term of this patent is extended or adjusted under 35 U.S.C. 154(b) by 270 days.

(21) Appl. No.: 11/236,199

(22) Filed: Sep. 27, 2005

(65) Prior Publication Data

US 2006/0082506 A1 Apr. 20, 2006

(30) Foreign Application Priority Data

Oct. 14, 2004 (TW) ..... 93131132 A

(51) Int. Cl.
*H01Q 1/36* (2006.01)

(52) U.S. Cl. ..... 343/895; 343/702

(58) Field of Classification Search ..... 343/895, 343/700 MS, 702

See application file for complete search history.

(56) References Cited

U.S. PATENT DOCUMENTS 6,111,545 A * 8/2000 Saari ..... 343/702
6,124,831 A * 9/2000 Rutkowski et al. .. 343/700 MS
6,130,651 A 10/2000 Yanagisawa et al. ..... 343/895
6,295,029 B1 9/2001 Chen et al. ..... 343/700
6,320,545 B1 * 11/2001 Nagumo et al. ..... 343/700 MS
6,337,663 B1 1/2002 Chi-Ming ..... 343/702
6,504,511 B2 1/2003 Andersson ..... 343/702
6,535,170 B2 3/2003 Sawamura et al. ..... 343/702
6,750,821 B2 6/2004 Fang et al. ..... 343/700
6,963,307 B2 * 11/2005 Mohamadi ..... 343/700 MS

FOREIGN PATENT DOCUMENTS

TW 507399 11/2001
TW 518804 11/2001
TW 519779 2/2003

* cited by examiner

*Primary Examiner*—Hoanganh Le
(74) *Attorney, Agent, or Firm*—Thomas, Kayden, Horstemeyer & Risley

(57) ABSTRACT

A dual band antenna device operable in a first frequency band and a second frequency band is disclosed. The device comprises a first radiation body and a second radiation body. The first radiation body forms a single path with at least two bend portions. A portion of the second radiation body is parallel to a portion of the first radiation body in a specific distance. In addition, a wireless communication device and radio frequency chip having a built in dual band antenna device are also disclosed.

44 Claims, 10 Drawing Sheets

DUAL BAND ANTENNA DEVICE, WIRELESS COMMUNICATION DEVICE AND RADIO FREQUENCY CHIP USING THE SAME

BACKGROUND

The invention relates to an antenna device, and in particular, to a dual band antenna device, a wireless communication device and radio frequency chip using the same.

Design goals for personal mobile communication devices or wireless terminal equipment focus on light weight, thinness, compact profile and good communication quality. Taking mobile phones as an example, small streamlined models with good communication quality and low cost are prevalent.

Presently, most personal mobile communication devices or wireless terminal equipment such as mobile phones use exposed wire antennas. The exposed wire antenna protrudes from the surface of the mobile phone such that the appearance of the mobile phone is not attractive and the protrusion of the antenna makes the phone inconvenient to carry. In addition, the cost of an exposed antenna is higher than that of a plane antenna. Furthermore, designing exposed antenna for mobile phones operating in dual band frequency or multiband frequency is more complicated and requires an impedance matching circuit for joint operation.

SUMMARY

The invention is directed to a dual band antenna device adopting a polygon-like planar antenna design. Such a design enables easy adjustment of resonant characteristics of the dual band antenna, reduces fine-tuning time of antenna characteristics and improves product throughput.

The invention is directed to a wireless communication device using a dual band antenna device of the invention provided inside the wireless communication device, thereby obtaining flexible design, appealing appearance and lower cost than those using exposed antennas.

The invention is directed to a radio frequency (RF) chip fabricated by semiconductor process to integrate a dual band antenna device of the invention and a radio frequency circuit unit into a single chip, and the manufacturers can use the RF chip to make compact, light weight wireless communication devices.

A dual band antenna device according to an exemplary embodiment of the invention is operable in a first frequency band and a second frequency band. The dual band antenna device comprises a first radiation body and a second radiation body. The first radiation body has a single path with at least two bend portions. The single path of the radiation body has a first end for feeding signal into the first radiation body, and a second end for connecting the second radiation body. A portion of the second radiation body is parallel with and spaced to the first radiation body with a specific distance.

A wireless communication device according to another embodiment of the invention has the feature of using the dual band antenna of the invention. The wireless communication device comprises a radio frequency (RF) module for processing a RF signal, and a dual band antenna device coupled to the RF module for receiving or transmitting the RF signal operating in a first frequency band and a second frequency band. The dual band antenna device comprises a first radiation body and a second radiation body. The first radiation body has a single path with at least two bend portions. The single path of the radiation body has a first end for feeding signal into the first radiation body, and a second end for connecting the second radiation body. A portion of the second radiation body is parallel with and spaced apart from the first radiation body by a specific distance.

A radio frequency (RF) chip according to another embodiment of the invention has the feature of integrating the dual band antenna of the invention in a single chip. The RF chip comprises a substrate, a RF circuit unit provided on the RF chip for processing RF signal, and a dual band antenna device coupled to the RF circuit unit for receiving or transmitting the RF signal operating in a first frequency band and a second frequency band. The dual band antenna device comprises a first radiation body and a second radiation body. The first radiation body has a single path with at least two bend portions. The single path of the radiation body has a first end for feeding signal into the first radiation body, and a second end for connecting the second radiation body. A portion of the second radiation body is parallel with and spaced apart from the first radiation body by a specific distance.

BRIEF DESCRIPTION OF THE DRAWINGS

The following detailed description, given by way of example and not intended to limit the invention solely to the embodiments described herein, will best be understood in conjunction with the accompanying drawings, in which.

DETAILED DESCRIPTION OF THE INVENTION

A detailed description of the present invention is provided in the following.

Figure 1A:
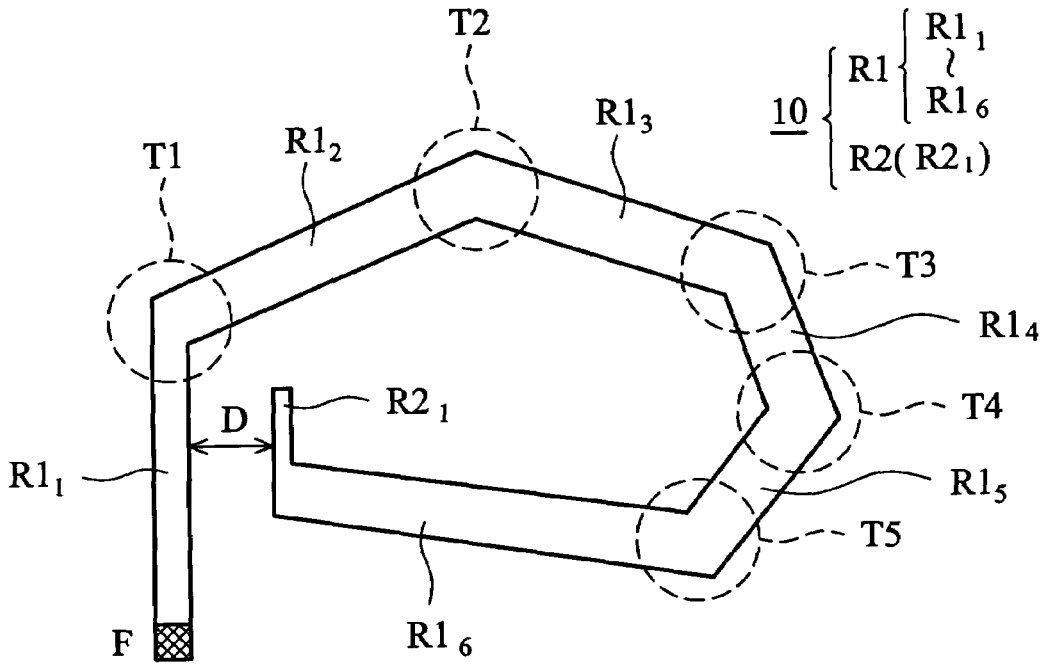
FIGS. 1*a* and 1*b* are diagrams showing two exemplary embodiments of dual band antenna devices according to the invention.

FIG. 1*a* is a diagram showing an exemplary embodiment of a dual band antenna device according to the invention.

The dual band antenna device 10, operable in a first frequency band and a second frequency band, comprises a first radiation body R1 with a first end and a second end, a signal feeder point F provided at the first end of the first radiation body R1 for feeding signals to the first radiation body R1, and a second radiation body R2 connected to the second end of the first radiation body R1. The first radiation body R1 has a single path, with a plurality of bend portions (or turning points), constituted of a plurality of first path conductors. For example, six first path conductors $R1_1$~$R1_6$, respectively extending in different directions, are connected to form the single path of the first radiation body R1 with five bend portions T1~T5. The second radiation body R2 is connected to the second end of the first radiation body R1, i.e. to the first path conductor $R1_6$.

Figure 1B:
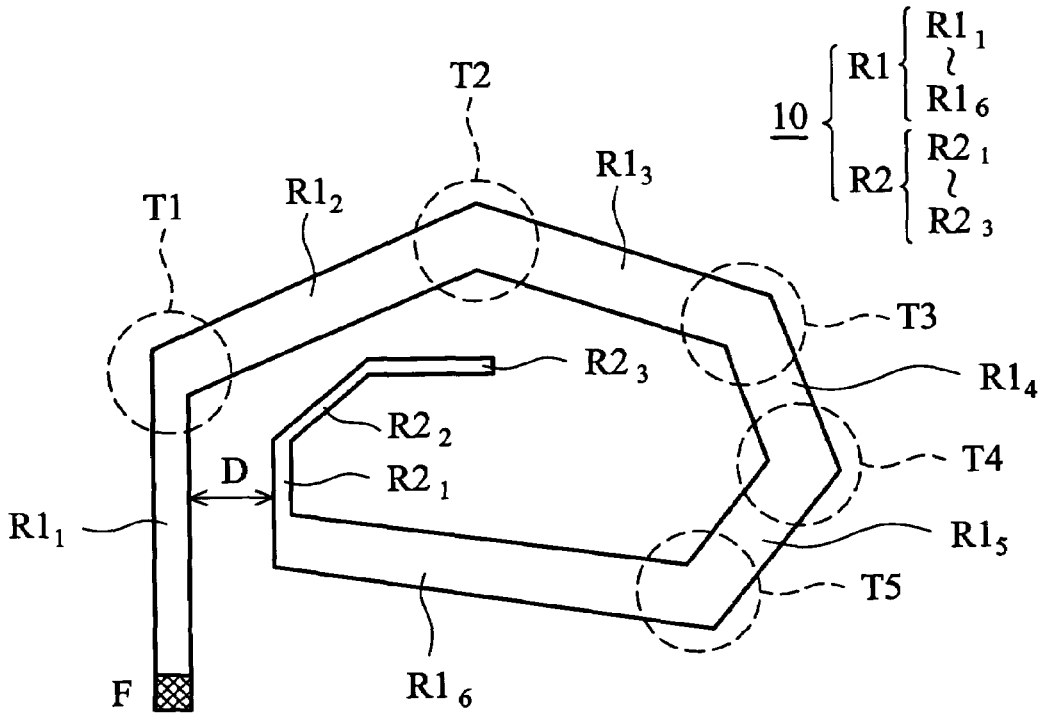

The second radiation body R2 also has a single path and may be constituted of only a second path conductor $R2_1$ as shown in FIG. 1, or a plurality of second path conductors $R2_1$~$R2_3$ connected together as shown in FIG. 1*b*. In FIG. 1*b*, the second path conductors $R2_1$ to $R2_3$ respectively extend toward different directions. A portion of the second radiation body R2, for example the second path conductor $R2_1$, is provided in parallel to and spaced with a specific distance D to the first path conductor $R1_1$.

In this embodiment, the specific distance D is preferred less than $0.05\lambda_1$, where $\lambda_1$ is the wavelength corresponding to the central frequency (hereinafter referred to as a first resonant frequency) of the first frequency band. The first resonant frequency depends on the length of the first radiation body R1, i.e. the total length of the first path conductors $R1_1$~$R1_6$. The length of the first radiation body $R_1$ is substantially equal to $\lambda_1/4$. In addition, the central frequency of the second frequency band (hereinafter referred to as a second resonant frequency) depends on the total length of the first and second radiation bodies R1 and R2, i.e. the total length of the first path conductors $R1_1$~$R1_6$ and the second path conductor $R2_1$ in FIG. 1*a*. Furthermore, a certain proportion relationship exists between the first resonant frequency and the second resonant frequency and depends on the specific distance D. Consequently, designers can control the second resonant frequency by adjusting the specific distance D and the length of the second radiation body R2. In this embodiment, the second resonant frequency substantially equals 1.5~2.5 times the first resonant frequency.

Figure 2A:
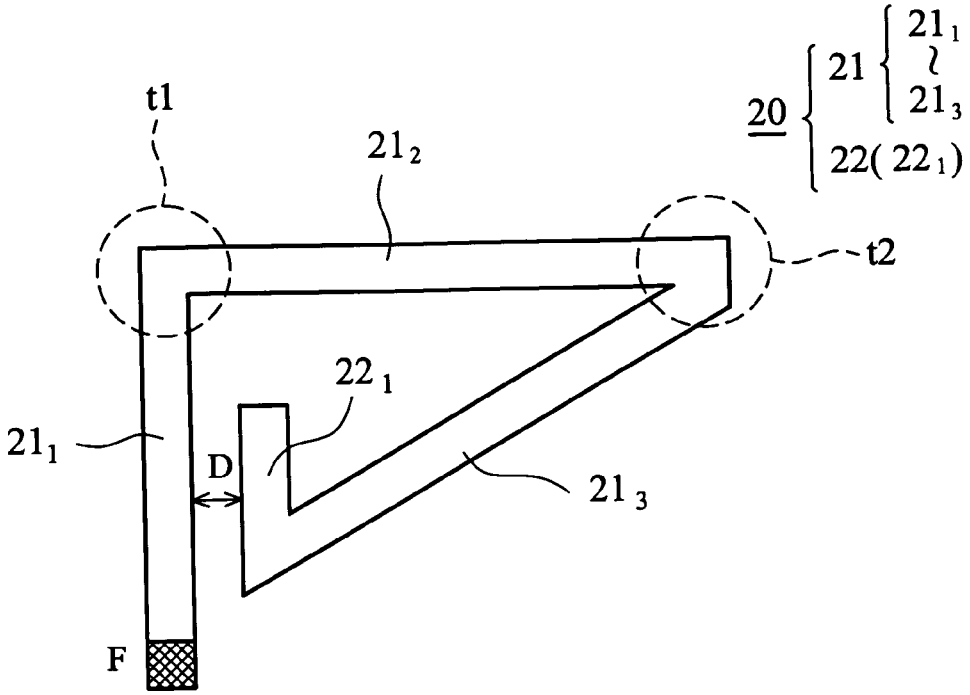
FIGS. 2*a* and 2*b* are diagrams showing another two exemplary embodiments of the dual band antenna devices according to the invention.
Figure 2B:
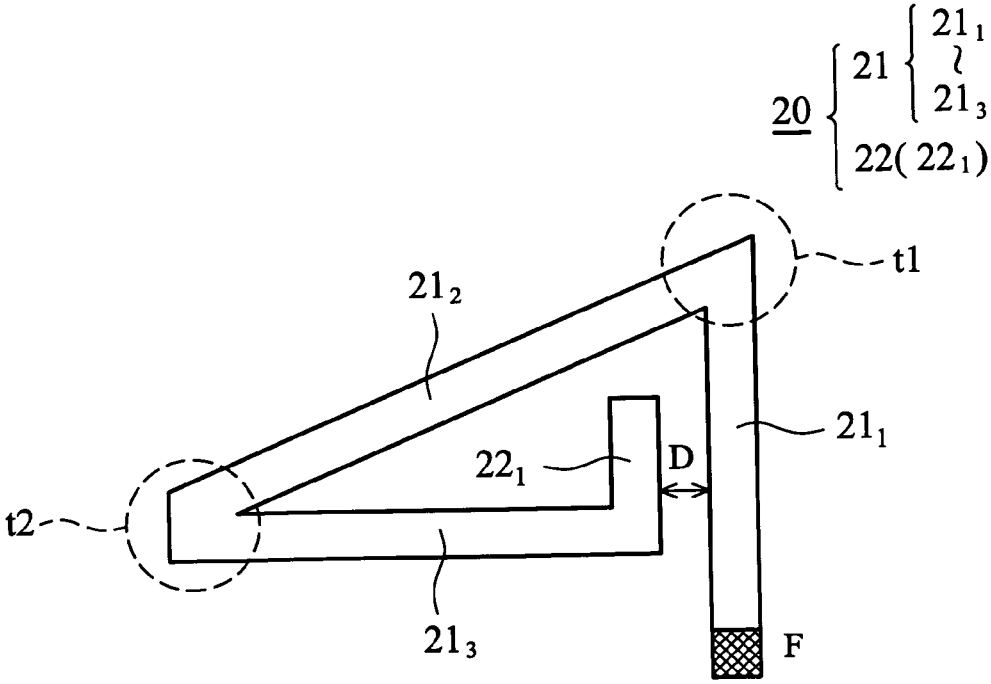

FIGS. 2*a* and 2*b* are diagrams showing another two exemplary embodiments of the dual band antenna devices according to the invention. In FIG. 2*a* or 2*b*, the dual band antenna device 20 comprises a first radiation body 21 with three first path conductors $\mathbf{21}_1$ to $\mathbf{21}_3$ connected together, thereby forming a single path having two bend portions, t1 and t2. A second radiation body 22 with a second path conductor $\mathbf{22}_1$ parallel to the first path conductor $\mathbf{21}_1$ is also formed. A signal feeder point F is disposed at the first end of the first radiation body 21 and the second radiation body 22 connects to the second end of the first radiation body 21. Similarly, the first path conductor $\mathbf{21}_1$ and the second path conductor $\mathbf{22}_1$ are spaced with a distance D less than $0.05\lambda_1$.

Figure 3A:
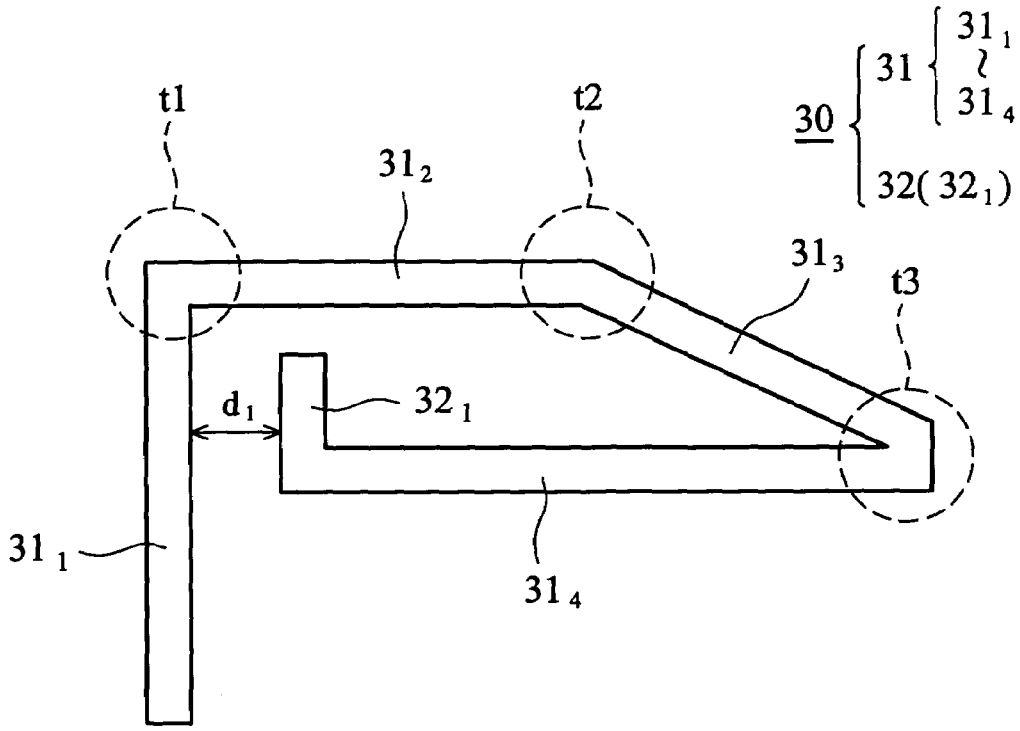
FIGS. 3*a* to 3*c* are diagrams showing another three exemplary embodiments of the dual band antenna devices according to the invention.
Figure 3B:
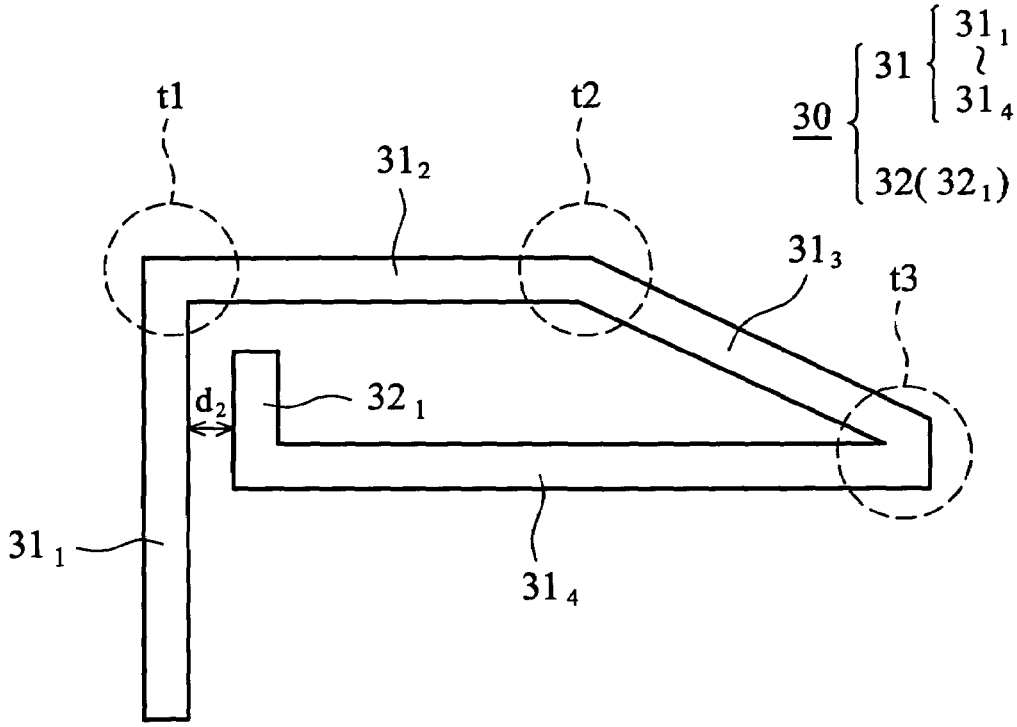
Figure 3C:
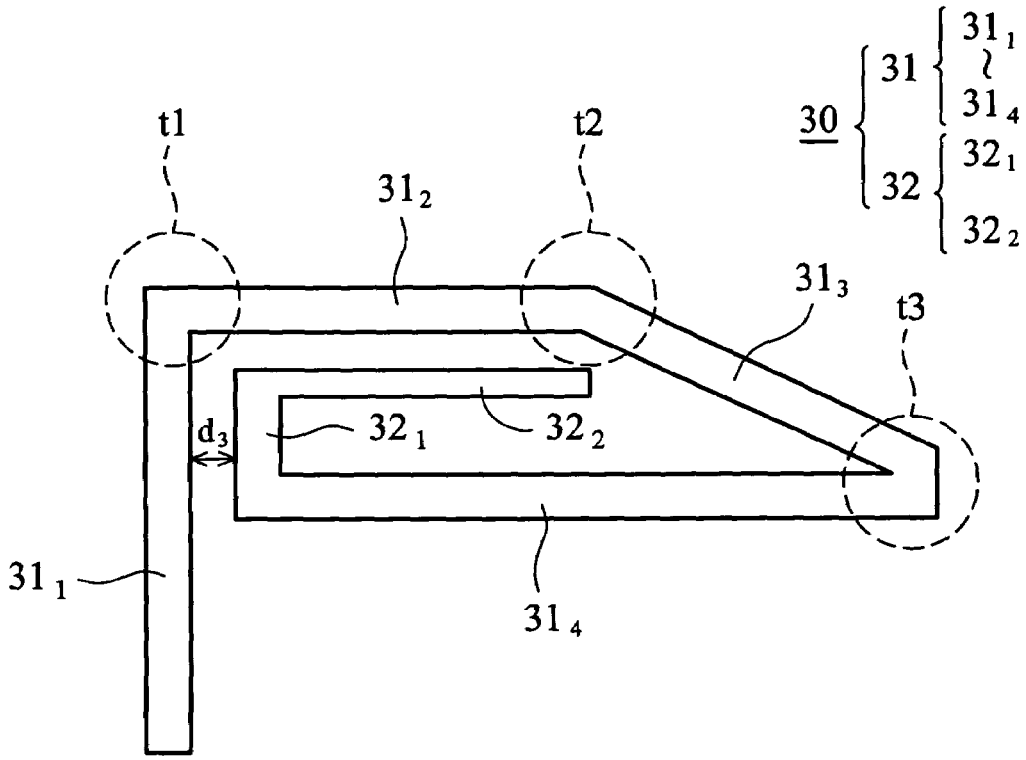

FIGS. 3*a* to 3*c* are diagrams showing another three exemplary embodiments of the dual band antenna devices according to the invention. The first radiation body 31 of any of the three dual band antenna devices 30 in FIGS. 3*a* to 3*c* are constituted of 4 first path conductors $\mathbf{31}_1$~$\mathbf{31}_4$, forming a single path with 3 bend portions t1~t3. In FIG. 3*a* or 3*b*, the second radiation body 32 merely has a second path conductor $\mathbf{32}_1$. In FIG. 3*c*, the second radiation body 32 has two second path conductors $\mathbf{32}_1$ and $\mathbf{32}_2$. The first resonant frequency $f_1$ of the dual band antenna device 30 are operable in the GSM 900 band (about 880~960 MHz) and therefore the length of the first radiation body 31 is designed to be about $\lambda_1/4$, where $\lambda_1$ is the corresponding wavelength of 900 MHz. In addition, the second resonant frequency $f_2$, $f'_2$ or $f''_2$ changes in response to the specific distance $d_1$, $d_2$ or $d_3$ and the length of the second radiation body 32. Any of the second resonant frequencies $f_2$, $f'_2$ and $f''_2$ changes from 1.5 to 2.5 times the first resonant frequency $f_1$. Furthermore, the specific distances $d_1$, $d_2$ and $d_3$ are less than $0.05\lambda_1$.

Figure 4:
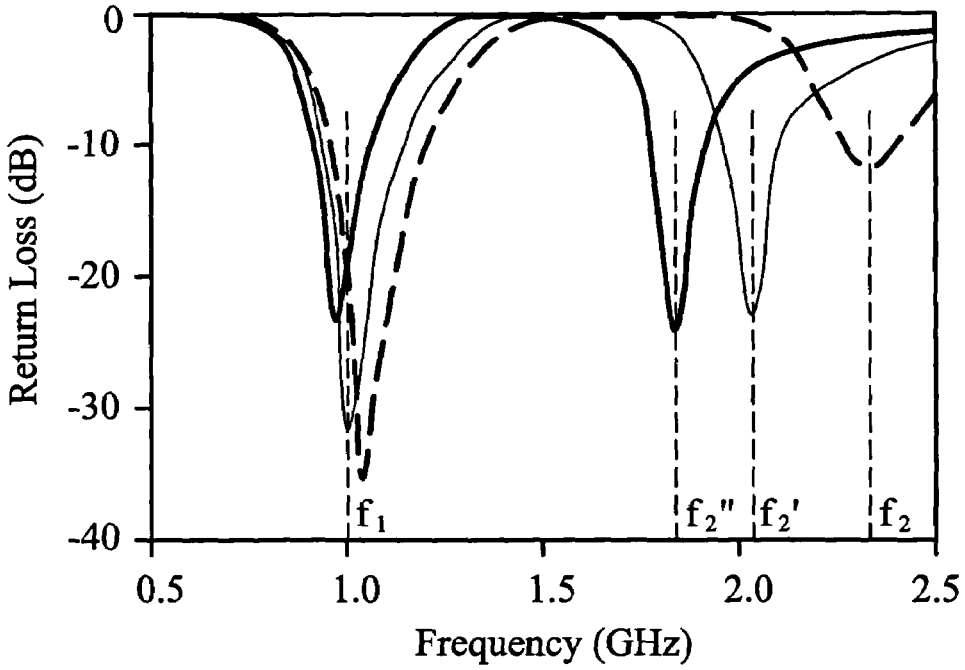
FIG. 4 is a diagram showing frequency responses of the dual band antenna devices of FIGS. 3*a* to 3*c;*

FIG. 4 is a diagram showing frequency responses of the dual band antenna devices of FIGS. 3*a* to 3*c*. The first and second resonant frequencies of the dual band antenna devices in FIGS. 3*a* to 3*c* are ($f_1$, $f_2$), ($f_1$, $f'_2$) and ($f_1$, $f''_2$) respectively. FIG. 4 clearly-shows that the first resonant frequency $f_1$ is almost independent of the position and length of the second radiation body 32.

In FIGS. 3*a* to 3*c*, the spaced distance between the second path conductor 32, and the first path conductor $\mathbf{31}_1$ is $d_1$, $d_2$ and $d_3$ respectively, assuming that $d_1>d_2$ and $d_2=d_3$. In view of FIG. 4, it is clear that the second resonant frequencies $f_2$, $f'_2$ and $f''_2$ change with the position and length of the second radiation body 32. For example, when the specific distance between the first and second path conductors $\mathbf{31}_1$ and $\mathbf{32}_1$ decreases from $d_1$ to $d_2$, the second resonant frequency decreases from $f_2$ to $f'_2$. In addition, if the specific distances $d_2$ and $d_3$ are equal, when the length of the second radiation body 32 increases, for example from having only one second path conductor $\mathbf{32}_1$ (FIG. 3*b*) to having two second path conductors $\mathbf{32}_1$ and $\mathbf{32}_2$ (FIG. 3*c*), the second resonant frequency of the dual band antenna device decreases from $f'_2$ to $f''_2$. From experiments, the second resonant frequency ($f_2$, $f'_2$ or $f''_2$) changes within the range of 1.5~2.5 times the first resonant frequency $f_1$. Therefore, the dual band antenna device of the invention can be operable in the GSM 900 band and the DCS 1800 band by appropriately designing the first and second radiation bodies.

Figure 5:
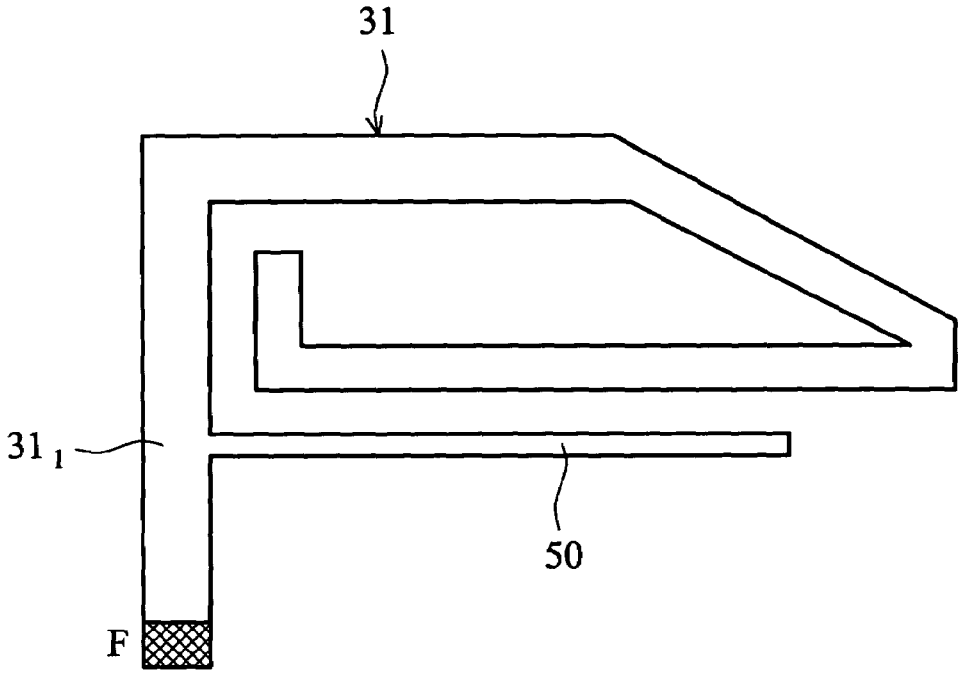
FIG. 5 is a diagram showing another dual band antenna device based on the structure described in FIG. 3*a;*

FIG. 5 is a diagram showing another dual band antenna device based on the structure described in FIG. 3*a*. In FIG. 5, the dual band antenna device further comprises a third path conductor 50 perpendicularly extending from the first path conductor $\mathbf{31}_1$ of the first radiation body 31. The third path conductor 50 is spaced with a distance to the first path conductor $\mathbf{31}_4$, generating a third resonant frequency $f_3$. The dual band antenna device is operable for DCS 1800 MHz and PCS 1900 MHz or ISM 2400 MHz when setting the third resonant frequency $f_3$ in vicinity of the second resonant frequency $f_2$.

Figure 6:
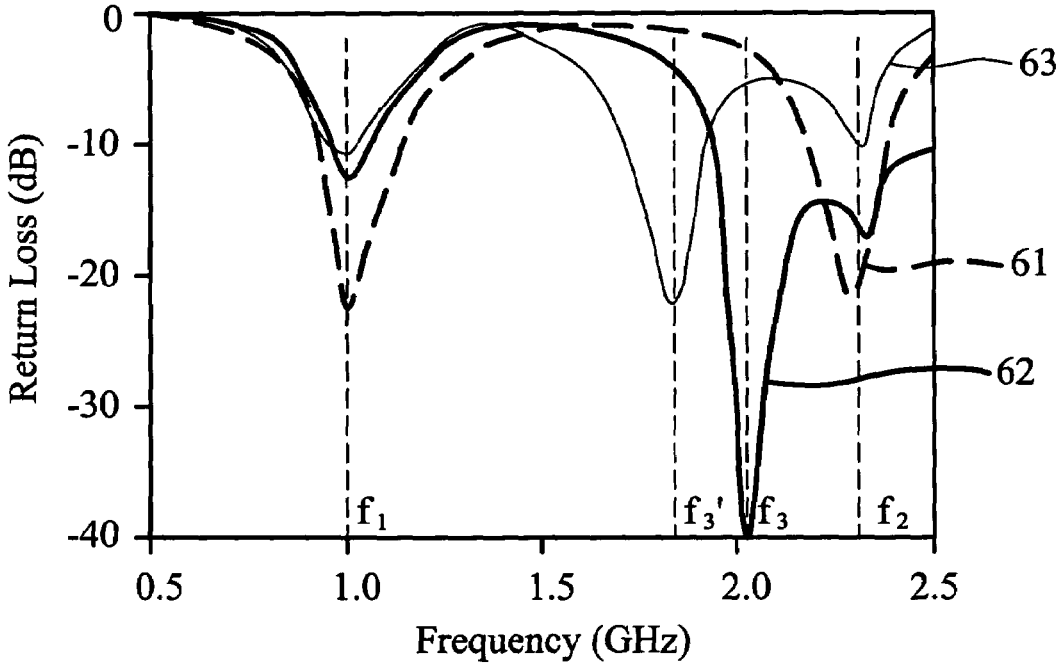
FIG. 6 is a diagram showing curves respectively represent frequency responses of the dual band antenna device based on FIG. 5 without and with the third path conductors.

In FIG. 6, curves 61, 62, and 63 respectively represent frequency responses of the dual band antenna device based on FIG. 5 without the third path conductor and with the third path conductors of lengths 25 mm and 30 mm respectively. In view of curves 61 to 63, the first and second resonant frequencies $f_1$ and $f_2$ resonated by the main body of the dual band antenna device are independent of the length of the path conductor 50. The third resonant frequencies $f_3$ and $f'_3$, however, decrease in response to increased length of the third path conductor 50.

Figure 7:
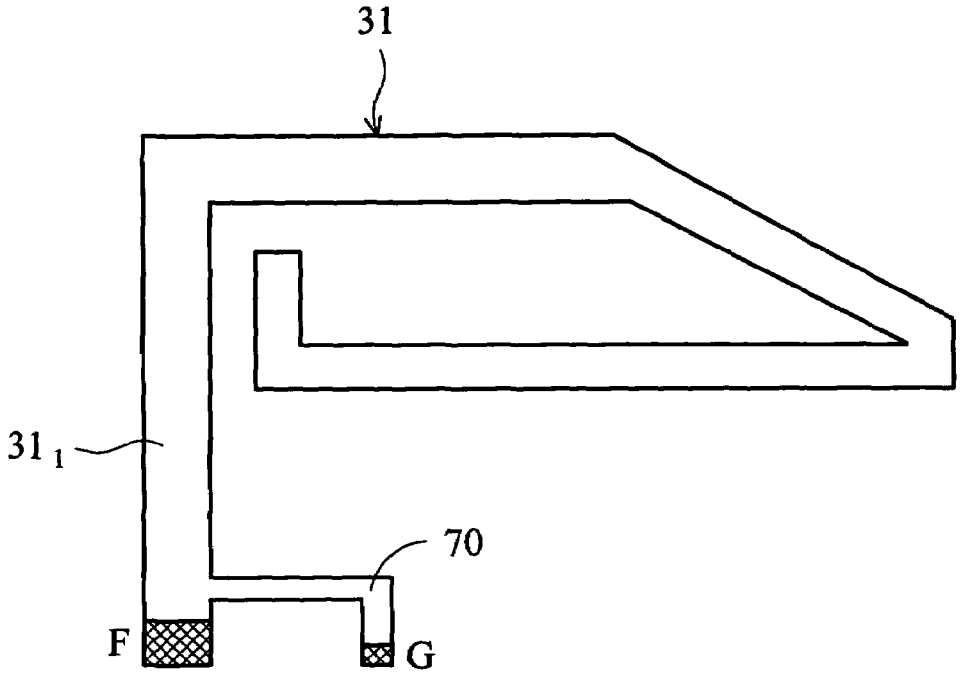
FIG. 7 is a diagram showing another dual band antenna device based on the structure described in FIG. 3*a;*

FIG. 7 is a diagram showing another dual band antenna device based on the structure described in FIG. 3*a*. In FIG. 7, the dual band antenna device further comprises a ground conductor 70 extending from the first path conductor $\mathbf{31}_1$ of the first radiation body 31. The end G of the ground conductor 70 connects to a ground plane disposed at a printed circuit board for example, serving as matching impedance for the first and second resonant modes of the dual band antenna device and replacing matching network disposed at the printed circuit board without degrading the operational bandwidth.

Figure 8:
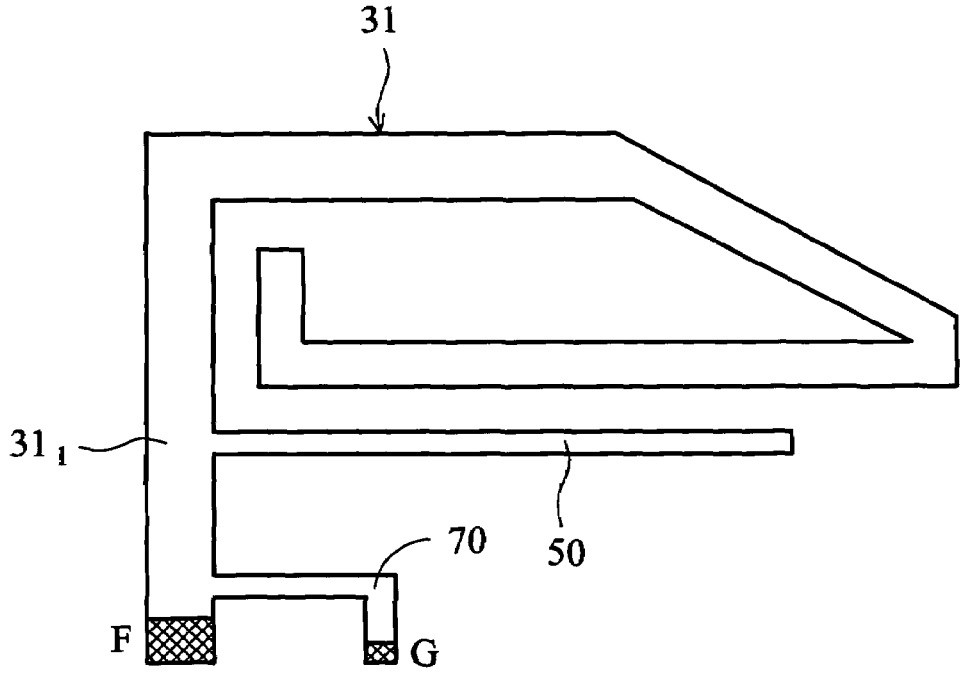
FIG. 8 is a diagram showing another dual band antenna device combining features of the embodiments described in FIGS. 5 and 7.

FIG. 8 is a diagram showing another dual band antenna device combining features of the embodiments described in FIGS. 5 and 7. This dual band antenna device is operable in multiple bands and wide bandwidth.

All embodiments of the dual band antenna devices described above can be applied to wireless communication devices such as personal mobile communication terminal apparatus (GSM, PCS, WCDMA cell phones, etc.) and other tiny communication apparatus.

Figure 9A:
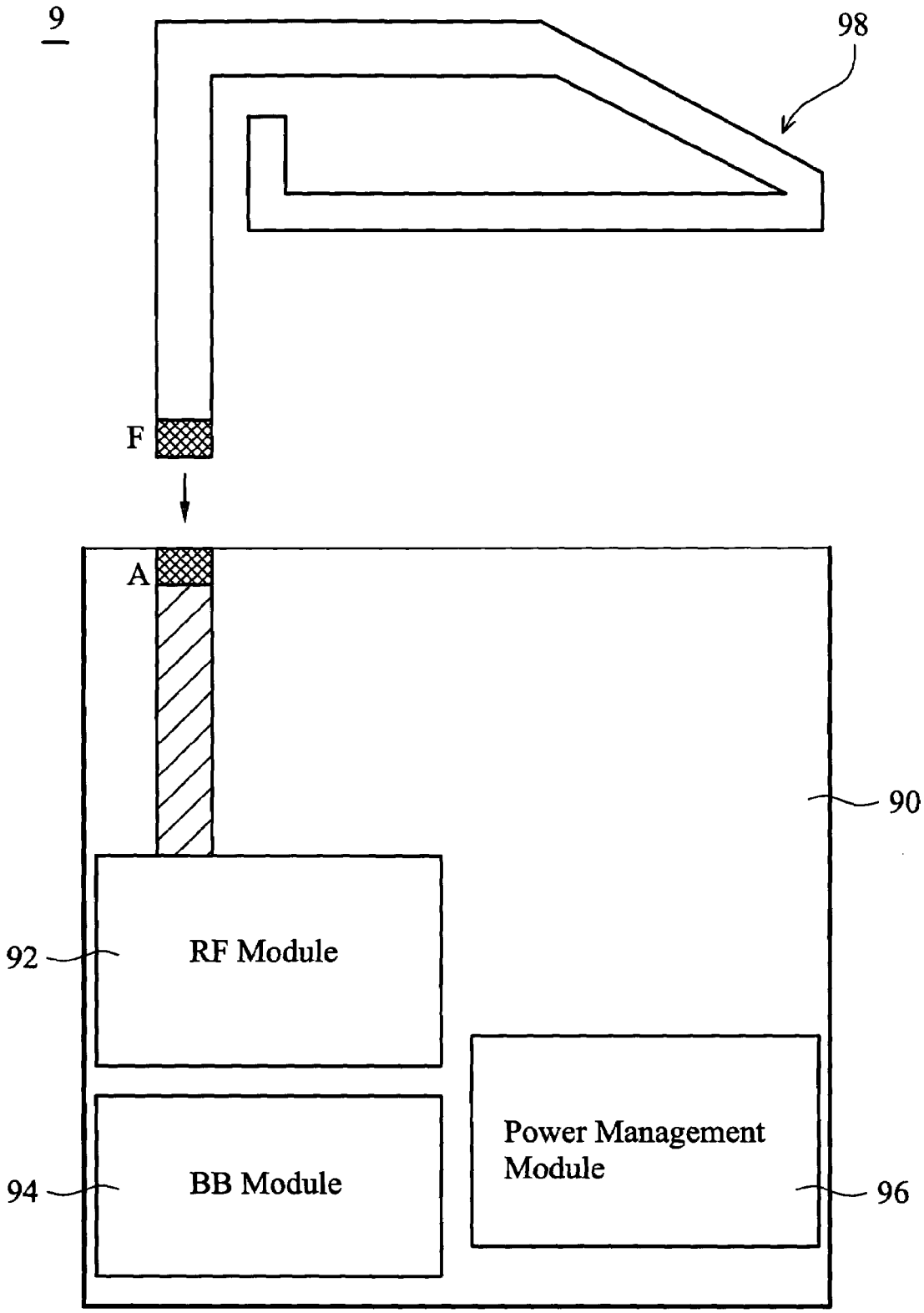
FIG. 9*a* is a diagram showing an exemplary embodiment of a wireless communication device using the dual band antenna devices according to the invention.

FIG. 9*a* is a diagram showing a wireless communication device using the described embodiments of the dual band antenna devices according to the invention. The wireless communication device 9 comprises a printed circuit board (PCB) 90, a radio frequency (RF) module 92 provided on the PCB 90 for processing radio signals, a base band (BB) module 94 provided on the PCB 90 for processing data and related control signals, a power management module 96 provided on the PCB 90 for managing power and supplying power to the RF module 92 and BB module 94, and a dual band antenna device 98 connecting the RF module 92 through a signal feeder point F and an output point of the PCB 90 for receiving or transmitting radio signals operating in a first frequency band and a second frequency band.

Figure 9B:
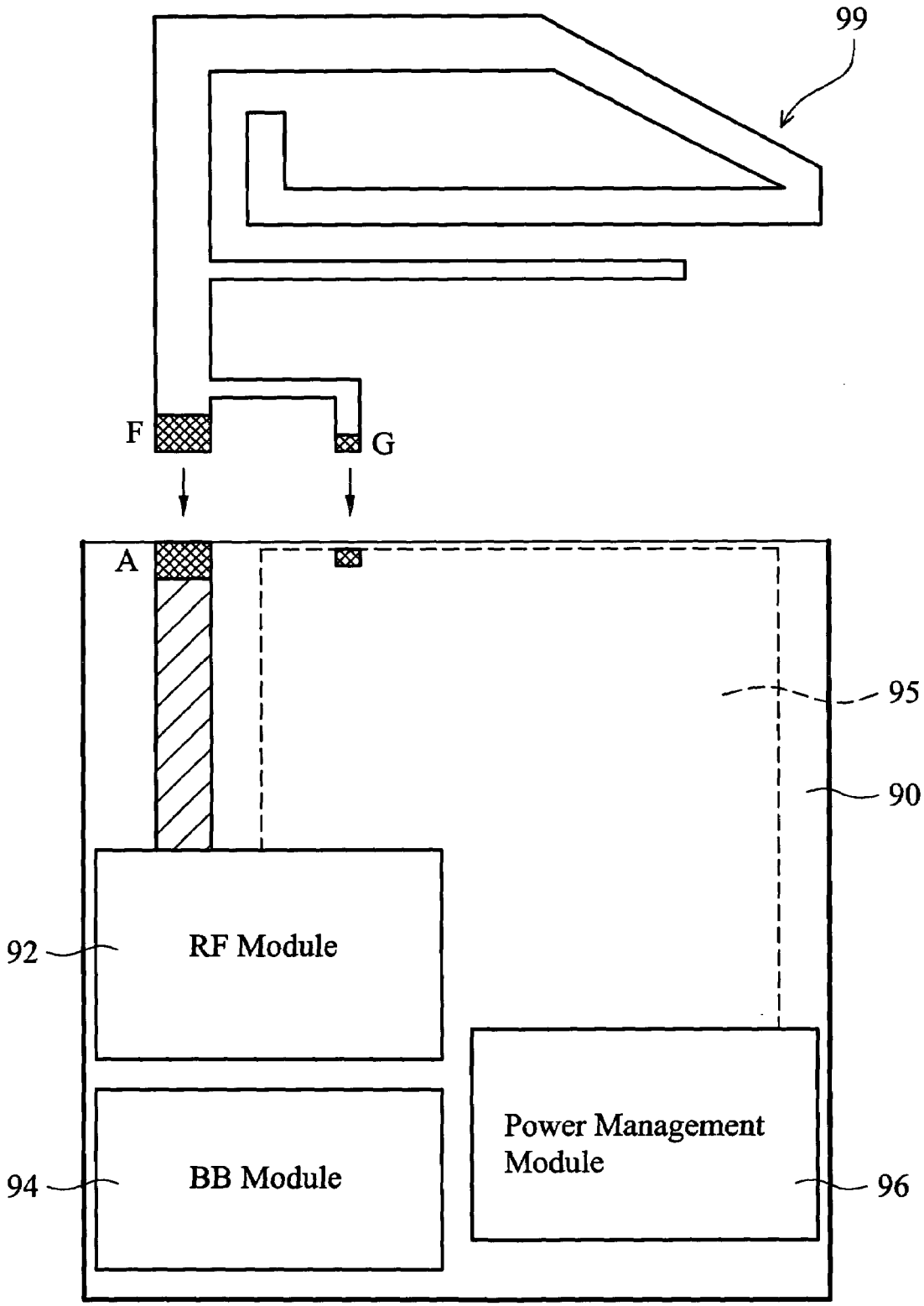
FIG. 9*b* is a diagram showing another exemplary embodiment of a wireless communication device using the dual band antenna device according to the invention.

In FIG. 9*a*, the wireless communication device 9 uses the antenna device described in FIG. 3 as the dual band antenna device 98 for example, but is not limited to this. Any dual band antenna device having the features described in FIGS. 1*a*, 1*b*, 2*a*, 2*b*, 2*c*, 3*a*~3*c*, 5, 7 and 8 can be applied to the wireless communication device 9 of FIG. 9, and is not described in detail for brevity. FIG. 9*b* is a diagram showing another wireless communication device using a dual band antenna device 99 with similar structure to that described in FIG. 8. A ground conductor of the dual band antenna 99 has an end G connected to a ground plane 95 provided on the PCB 90.

The dual band antenna devices applied to wireless communication devices can be independent components as shown in FIGS. 9*a* and 9*b*, or can be formed on the PCB 90 using a printing or etching process.

Figure 10:
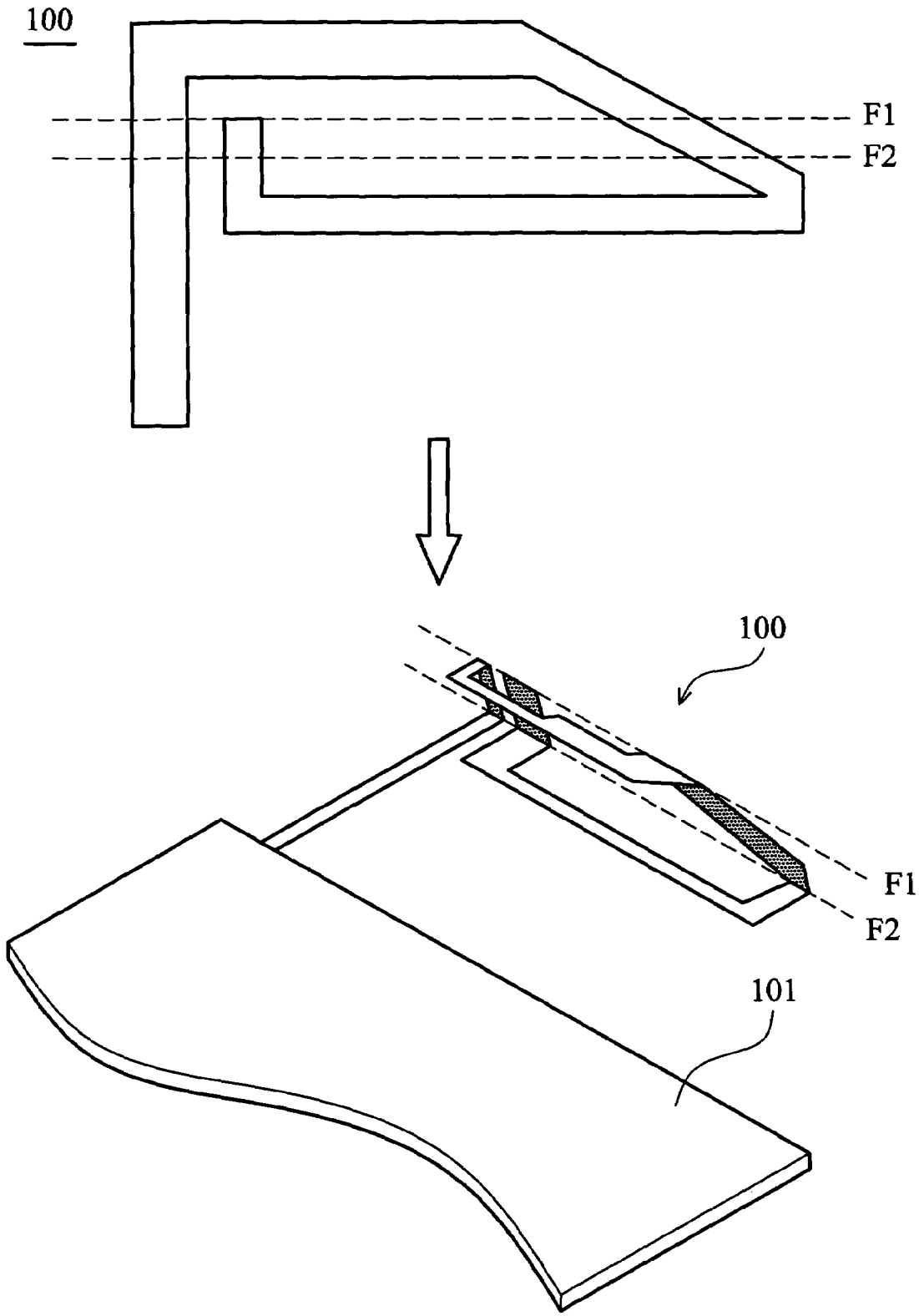
FIG. 10 is a diagram showing a dual band antenna device folded along folding lines F1 and F2 at specific angles.

Due to the tendency to design compact, light weight wireless communication devices, the appearance of a dual band antenna device must be modified to reduce the product size, match the PCB to the internal space of the wireless communication device without degrading performance. For example, the first and second radiation bodies of a dual band antenna device are folded along at least a folding line at a specific angle, thereby the dual band antenna device is divided into at least two portions on two different planes with the specific angle therebetween and modifying the appearance of the dual band antenna device to be three dimensional. For another example, the first and second radiation bodies of a dual band antenna device are folded along at least two folding lines by two angles, thereby dividing the dual band antenna device into at least three portions on three different planes every two of which have the corresponding angle therebetween. FIG. 10 is a diagram showing a dual band antenna device 100 folded along the folding lines F1 and F2 at substantially right angles. In FIG. 10, the portion between the folding lines F1 and F2 is substantially perpendicular to the printed circuit board (PCB) 101; all the other portions of the dual band antenna device are parallel with the PCB 101 and extend toward the PCB 101. Although the height of the folded dual band antenna device 100 increases, the area of the folded dual band antenna device 100 disposed along the same plane of the PCB 101 is slashed, and therefore the folded dual band antenna device 100 is appropriate for a compact, light weight wireless communication device with the described properties.

The dual band antenna device and radio frequency (RF) module used by a wireless communication device are two independent components, both operating in high frequency band. The dual band antenna device connects the RF module by direct contact, solder or connector. Parasitic impedance of the circuit may affect performance of the RF module when operating in high frequency band, and therefore the parasitic impedance at the connection between the antenna device and RF module degrades performance of the wireless communication device. Consequently, if the dual band antenna device and RF module are integrated in a single chip, the connection of the antenna device and RF module are integrally formed, thereby reducing parasitic impedance and variation of impedance among different chips.

Figure 11A:
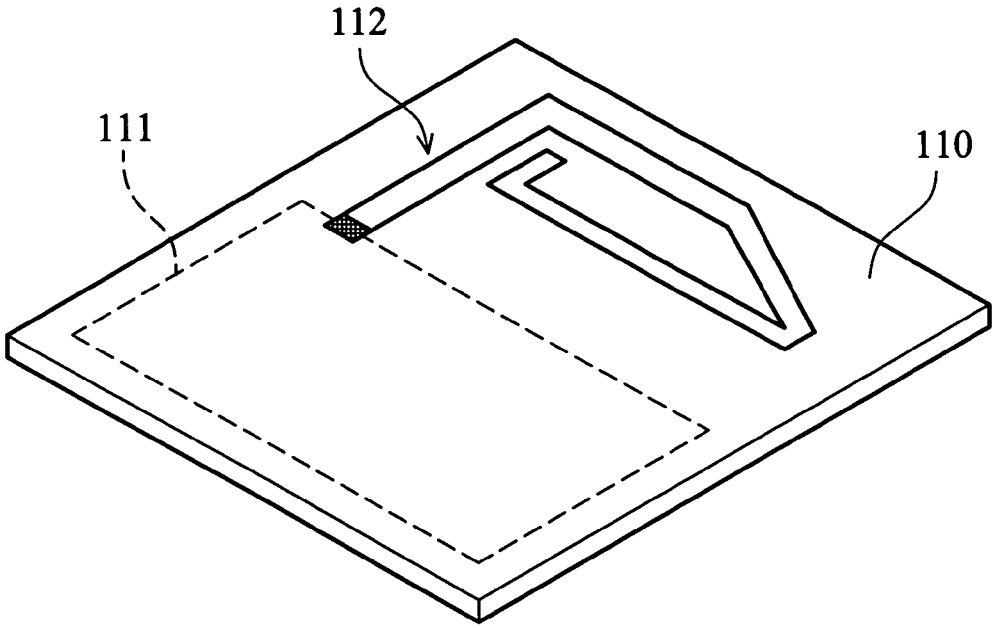
FIGS. 11*a* and 11*b* are diagrams showing radio frequency chips using dual band antenna devices according to exemplary embodiments of the invention.
Figure 11B:
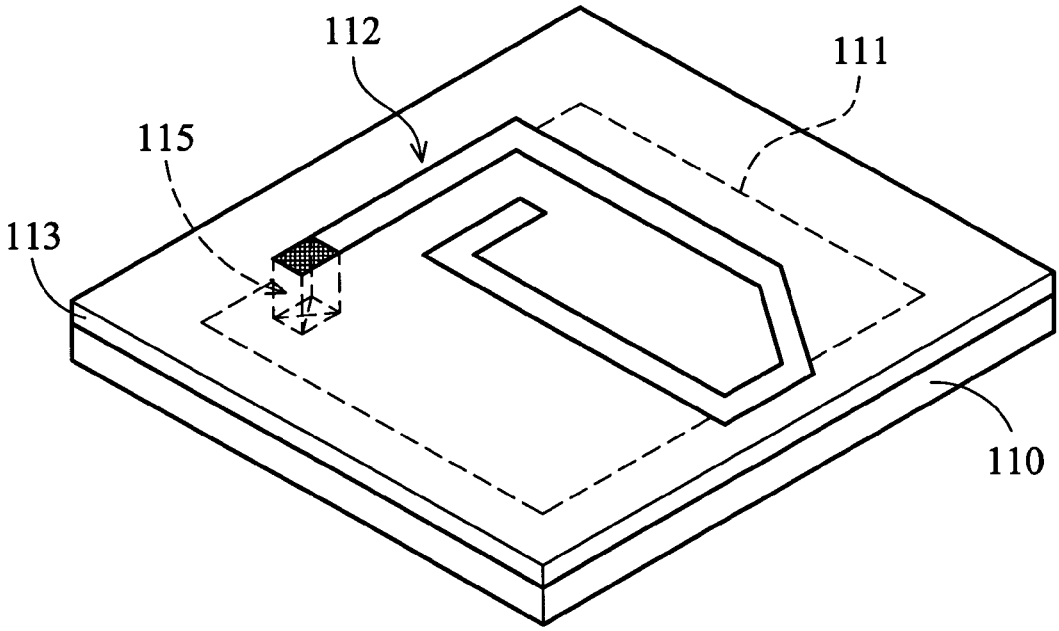

FIGS. 11*a* and 11*b* are diagrams showing radio frequency (RF) chips using dual band antenna devices according to exemplary embodiments of the invention. In FIG. 11*a*, the RF chip comprises a substrate 110, a radio frequency (RF) circuit unit 111 provided on the substrate 110 for processing radio signals, and a dual band antenna device 112 disposed on the substrate 110 and coupled to the RF circuit unit 111 for receiving or transmitting radio signals operating in a first frequency band and a second frequency band.

The dual band antenna device described in FIG. 3*a* is used by the RF chip of FIG. 11*a* as an example, but is not limited to this. Any dual band antenna device having features described in FIGS. 1*a*, 1*b*, 2*a*, 2*b*, 3*a*~3*c*, 5, 7 and 8 can be applied to the RF chip of FIG. 11*a*. The features of the above dual band antenna devices are not described here in detail for brevity. The dual band antenna device 112 and RF circuit unit 111 are fabricated by semiconductor process on the substrate 110. Also as depicted in FIG. 11*b*, the RF circuit unit 111 can first be formed on the substrate 110, then an isolation layer 113 is formed over the RF circuit unit 111, and finally the dual band antenna device 112 is formed above the isolation layer 113, connecting to the RF circuit 111 through a contact point 115.

While the invention has been described by way of examples and in terms of the preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A dual band antenna device operable in a first frequency band and a second frequency band comprising:

a first radiation body constituted of a first single path with at least two bend portions, having a first end for feeding a signal to the first radiation body and a second end; and a second radiation body connected to the second end of the first radiation body, provided in parallel to and spaced with respect to a portion of the first radiation body with a specific distance; and a third path conductor connected to the first radiation body;

wherein the central frequency of the first frequency band depends on the length of the first radiation body.

2. The dual band antenna device as claimed in claim 1, wherein the specific distance is less than 0.05 λ, and λ is the wavelength corresponding to the central frequency of the first frequency band.

3. The dual band antenna device as claimed in claim 1, wherein the central frequency of the second frequency band depends on the total lengths of the first and second radiation bodies.

4. The dual band antenna device as claimed in claim 1, wherein the central frequency of the second frequency band depends on the specific distance.

5. The dual band antenna device as claimed in claim 1, wherein the central frequency of the second frequency band is in a certain proportion to that of the first frequency band.

6. The dual band antenna device as claimed in claim 5, wherein the certain proportion depends on the specific distance.

7. The dual band antenna device as claimed in claim 5, wherein the central frequency of the second frequency band is 1.5~2.5 times that of the first frequency band.

8. The dual band antenna device as claimed in claim 1, wherein the first radiation body comprises a plurality of first path conductors respectively extending in different directions; and the second radiation body constituted of a second single path with at least a second path conductor provided in parallel with one of the first path conductors.

9. The dual band antenna device as claimed in claim 8, wherein the second radiation body has a plurality of the second path conductors which respectively extend in different directions and constitute the second single path.

10. The dual band antenna device as claimed in claim 8, wherein the first path conductor connected to the first end of the first radiation body and the second path conductor connected to the second end of the first radiation body are provided in parallel and spaced with the specific distance.

11. The dual band antenna device as claimed in claim 1, further comprising a substrate for providing the first and second radiation bodies thereon by a printing or etching process.

12. The dual band antenna device as claimed in claim 1, wherein the third path conductor perpendicularly extends from the first path conductor connected to the first end of the first radiation body.

13. The dual band antenna device as claimed in claim 1, further comprising a ground conductor connected to the first radiation body.

14. The dual band antenna device as claimed in claim 13, wherein the ground conductor is connected to the first end of the first radiation body.

15. The dual band antenna device as claimed in claim 1, wherein the first and second radiation bodies are selectively folded along a folding line at a specific angle such that the dual band antenna device is divided into two portions on two different planes which have the specific angle therebetween.

16. The dual band antenna device as claimed in claim 1, wherein the first and second radiation bodies are selectively folded along two folding lines at two specific angles such that the dual band antenna device is divided into three portions on three different planes, every two of which have the corresponding specific angle therebetween.

17. The dual band antenna device as claimed in claim 1, wherein the first and second radiation bodies are selectively folded along two folding lines such that the dual band antenna device is divided into a first, second and third portion on three different planes; the planes of the first and second portions are parallel to each other and the plane of the third portion leans at a specific angle with respect to the planes of the first and second portions.

18. A wireless communication device comprising:

a dual band antenna device receiving and transmitting a radio signal operating in a first frequency band and a second frequency band; wherein the dual band antenna device comprises:

a first radiation body constituted of a first single path with at least two bend portions, having a first end for feeding the radio signal to the first radiation body and a second end; and a second radiation body connected to the second end of the first radiation body, provided in parallel to and spaced with respect to a portion of the first radiation body with a specific distance; and a third path conductor connected to the first radiation body;

wherein the central frequency of the first frequency band depends on the length of the first radiation body.

19. The wireless communication device as claimed in claim 18, wherein the specific distance is less than 0.05 λ, and λ is the wavelength corresponding to the central frequency of the first frequency band.

20. The wireless communication device as claimed in claim 18, wherein the central frequency of the second frequency band depends on the total length of the first and second radiation bodies.

21. The wireless communication device as claimed in claim 18, wherein the central frequency of the second frequency band depends on the specific distance.

22. The wireless communication device as claimed in claim 18, wherein the central frequency of the second frequency band is in a certain proportion to that of the first frequency band.

23. The wireless communication device as claimed in claim 22, wherein the certain proportion depends on the specific distance.

24. The wireless communication device as claimed in claim 22, wherein the central frequency of the second frequency band is 1.5~2.5 times that of the first frequency band.

25. The wireless communication device as claimed in claim 18, wherein the first radiation body comprises a plurality of first path conductors respectively extending in different directions; and the second radiation body is constituted of a second single path with at least a second path conductor provided in parallel with one of the first path conductors.

26. The wireless communication device as claimed in claim 25, wherein the second radiation body has a plurality of the second path conductors which respectively extend in different directions and constitute the second single path.

27. The wireless communication device as claimed in claim 25, wherein the first path conductor connected to the first end of the first radiation body and the second path conductor connected to the second end of the first radiation body are provided in parallel with and spaced by the specific distance.

28. The wireless communication device as claimed in claim 18, further comprising a substrate for providing the first and second radiation bodies thereon by a printing or etching process.

29. The wireless communication device as claimed in claim 18, wherein the third path conductor perpendicularly extends from the first path conductor connected to the first end of the first radiation body.

30. The wireless communication device as claimed in claim 18, further comprising a ground conductor connected to the first radiation body.

31. The wireless communication device as claimed in claim 30, wherein the ground conductor is connected to the first end of the first radiation body.

32. The wireless communication device as claimed in claim 18, wherein the first and second radiation bodies are selectively folded along a folding line by a specific angle such that the dual band antenna device is divided into two portions on two different planes which have the specific angle therebetween.

33. The wireless communication device as claimed in claim 18, wherein the first and second radiation bodies are selectively folded along two folding lines by two specific angles such that the dual band antenna device is divided into three portions on three different planes, every two of which have the corresponding specific angle therebetween.

34. The wireless communication device as claimed in claim 18, wherein the first and second radiation bodies are selectively folded along two folding lines such that the dual band antenna device is divided into a first, second and third portion on three different planes; the planes of the first and second portions are parallel to each other and the plane of the third portion leans at a specific angle with respect to the planes of the first and second portions.

35. A radio frequency chip comprising:

a substrate;

a dual band antenna device provided on the substrate, receiving and transmitting a radio signal operating in a first frequency band and a second frequency band; wherein the dual band antenna device comprises:

a first radiation body constituted of a first single path with at least two bend portions, having a first end for feeding the radio signal to the first radiation body and a second end; and a second radiation body connected to the second end of the first radiation body, provided in parallel to and spaced apart from a portion of the first radiation body by a specific distance; and a third path conductor connected to the first radiation body;

wherein the central frequency of the first frequency band depends on the length of the first radiation body.

36. The radio frequency chip as claimed in claim 35, wherein the specific distance is less than 0.05 λ, and λ is the wavelength corresponding to the central frequency of the first frequency band.

37. The radio frequency chip as claimed in claim 35, wherein the central frequency of the second frequency band depends on the total length of the first and second radiation bodies.

38. The radio frequency chip as claimed in claim 37, wherein the central frequency of the second frequency band is in a certain proportion to that of the first frequency band.

39. The radio frequency chip as claimed in claim 38, wherein the certain proportion depends on the specific distance.

40. The radio frequency chip as claimed in claim 38, wherein the central frequency of the second frequency band is 1.5~2.5 times that of the first frequency band.

41. The radio frequency chip as claimed in claim 35, wherein the first radiation body comprises a plurality of first path conductors respectively extending toward different directions; and the second radiation body constituted of a second single path with at least a second path conductor provided in parallel with one of the first path conductors.

42. The radio frequency chip as claimed in claim 35, wherein the first and second radiation bodies are formed on the substrate using semiconductor process.

43. The radio frequency chip as claimed in claim 35, further comprising a ground conductor connected to the first radiation body.

44. The radio frequency chip as claimed in claim 43, wherein the ground conductor is connected to the first end of the first radiation body.

* * * * *